US008054244B2

(12) United States Patent
Lu et al.

(10) Patent No.: US 8,054,244 B2
(45) Date of Patent: Nov. 8, 2011

(54) METHOD AND APPARATUS FOR DRIVING MULTI-SEGMENT DISPLAY DEVICE

(75) Inventors: Chih-Chiang Lu, Hsin Chu (TW); Chung-Yi Chang, Tai Chung Hsien (TW); Jau-Min Ding, Taipei (TW); Chi-Chang Liao, Tai Nan (TW)

(73) Assignee: Industrial Technology Research Institute, Hsinchu County (TW)

( * ) Notice: Subject to any disclaimer, the term of this patent is extended or adjusted under 35 U.S.C. 154(b) by 1468 days.

(21) Appl. No.: 11/167,102

(22) Filed: Jun. 28, 2005

(65) Prior Publication Data

US 2006/0145948 A1 Jul. 6, 2006

(30) Foreign Application Priority Data

Dec. 31, 2004 (TW) ..... 93141910 A

(51) Int. Cl.
*G09G 3/04* (2006.01)

(52) U.S. Cl. ..... 345/33

(58) Field of Classification Search ..... 345/33–54
See application file for complete search history.

(56) References Cited

U.S. PATENT DOCUMENTS 3,902,790 A 9/1975 Hsieh et al.
4,137,524 A * 1/1979 Chen et al. ..... 345/50
5,155,476 A 10/1992 Shioji
6,556,515 B1 4/2003 Sekiguchi

OTHER PUBLICATIONS

Intel Data Catalog, copyright 1975, Intel Corporation of Santa Clara, California, pp. 8-3 to 8-6, Liquid crystal Display Decoder driver (Silicon Gate CMOS 5201, 5201-2, 5202, 5202-2).*

* cited by examiner

*Primary Examiner* — Sumati Lefkowitz
*Assistant Examiner* — Robert E Carter, III
(74) *Attorney, Agent, or Firm* — Birch, Stewart, Kolasch & Birch, LLP

(57) ABSTRACT

A method and an apparatus for driving multi-segment display device are described. According to the present invention, problems of driving the electrode wire activation mode of the conventional liquid crystal display are solved by the driving waveforms. The driving waveforms of non-display area are in the OFF mode, where the non-display area has pixels in the OFF mode, driving electrode wires and background area. Problems of driving voltage wire activation mode are decreased, cost is lowered, and processing is simplified, so that every pixel of the display device will be controlled precisely.

19 Claims, 6 Drawing Sheets

METHOD AND APPARATUS FOR DRIVING MULTI-SEGMENT DISPLAY DEVICE

BACKGROUND OF THE INVENTION

1. Field of the Invention

The present invention relates to a driving method and a driving apparatus, and in particular to a method and an apparatus for driving multi-segment display device.

2. Description of Related Art

To drive multi-segment display devices used to illustrate characters (e.g. numeric or alphabetical), a clock signal having continuous square wave and a control continuous wave as an input signal is conventionally used to determine whether a "ON" or "OFF" mode is used. With a driving circuit, the input signal is converted into a continuous square wave having two polarities. Amplitudes of the continuous square wave are used to determine whether the "ON" or "OFF" modes of corresponding pixels are used. Because many display media well known in the art such as liquid crystal (LC) display medium or non-LC display medium have different characteristics, it therefore arises an issue to drive the pixels into "ON" mode for multi-segment display devices accompanying with also driving the corresponding electrically wires into "ON" mode by the conventional segment driving.

In addition, when the multi-segment display devices are assembled, segment electrodes corresponding to the segments of upper substrates and lower substrates need to be aligned accurately. This results in higher costs and low production yield. To overcome the above-mentioned disadvantages, it is usually improved to avoid the driving electrical wires in the process by, for instance, increasing the light-absorbing layer upon the electrical wires or avoiding the electrical wires with respect to different display media such as electrochromic display (ECD) which disposes the display medium in the right positions to avoid the electrical wires. However, it is not a direct means to solve the electrical wires to be mistakenly driven into the "ON" mode.

FIG. 1A is a conventional driving circuit for a display device. Referring to FIG. 1, each pixel of the display device corresponds to a set of input signals and a conversion circuit 16. The conventional driving circuit includes a control input terminal 12 and an input signal terminal 10. A clock signal is supplied to the control input terminal 12 of the conventional driving circuit, and the frequency of the clock signal is the AC signal having two polarities supplied to corresponding pixel of the display device. A logic control signal is supplied to the input signal terminal 16 and used to switch between the "ON" or "OFF" modes of the corresponding pixels. Also, both the control input terminal 12 and the input signal terminal 16 are coupled to an exclusive OR (XOR) gate 14. Then, the control input terminal 12 and the input signal terminal 16 are connected to an amplifier or a signal scaler so that logic output levels are converted to a plurality of voltages. The voltages include a segment voltage 18 and a common voltage 20, and are used to drive display medium 22 of the display devices.

FIG. 1B shows segment driving waveforms of the segment voltages of the conventional driving circuit. Referring to FIG. 1B, a waveform of signal supplied to the input signal terminal 10 is indicated by reference numeral 100, and a waveform of signal supplied to the control input terminal 12 is indicated by reference numeral 102. A waveform of signal having the common voltage 20 is indicated by reference numeral 104. A waveform of signal having the segment voltage 18 is indicated by reference numeral 106. A waveform of a signal having a voltage drop of the common voltage 20 and the segment voltage 18 is indicated by reference numeral 108.

The signal having the waveform 108 has a voltage to activate the display medium. The waveform of the signal supplied to the segment electrodes and the common electrodes has amplitudes of F, and the signal has one polarity. However, the segment electrodes and the common electrodes are likely positioned opposite to the backgrounds of display device. Electrical fields generated by the signals having the waveform 108 have impact on the modes of display medium. Thus, the electrical fields are higher than threshold value of the display medium so that modes of display medium are changed.

Reference is made to FIG. 2. FIG. 2 schematically illustrates a driving circuit for the display device in the prior art. The "ON" mode is driven by a driving common voltage 112 and a driving segment voltage 114. The "OFF" mode is driven by a driving common voltage 112 and a driving segment voltage 28. Referring to FIG. 2, a pixel with the "ON" mode and a pixel with the "OFF" mode are shown (FIG. 2 may include more pixels). The "ON" mode is indicated by a display medium active mode 24, and the "OFF" mode is indicated by a display medium inactive mode 26. However, pixels of non-display area should not be lit (even the background light should not be lit), and pixels of display area should normally be lit. If the clock signal having the waveforms as shown in FIG. 1B is applied, then a segment driving voltage $V_{LS,ON}=V(clk,-)-V_{cg}$ of the ON mode is generated. Besides, a segment driving voltage $V_{LS,OFF}=V(clk,+)-V_{cg}$ of the OFF mode is generated. The voltage V(clk,+) is the segment electrode voltage of the OFF mode, and the voltage V(clk,−) is the segment electrode voltage of the ON mode. The voltage $V_{cg}$ is a common background voltage. In the prior art, the common background voltage or the segment background voltage may be floating as a result of uncertain voltage. That is, the common background or segment background may be lit or may not be lit. (It depends on the display mediums).

SUMMARY OF THE INVENTION

It is an object of the present invention to provide a driving method and a driving apparatus. The present invention is used to provide a driving signal having a driving waveform to switch between the ON mode and the OFF mode of pixels. Thus, when the pixels of display area are ON, the pixels, the driving electrical wires and background area of non-display area are OFF.

In order to accomplish the object of the present invention, the present invention provides a segment driving method. An input mode signal and a clock signal are supplied to activate a mode switch unit to switch between the modes of the display device. When the input mode signal is at a low level of voltage, the mode of the display device is switched to a first display mode. When the input mode signal has a high level of voltage, the mode of the display device is switched to a second display mode.

It is another object of the present invention to provide an apparatus for driving multi-segment display device. The present invention includes a plurality of mode switching units, at least one first level conversion circuit unit, at least one second level conversion circuit unit, a plurality of third level conversion circuit units and a plurality of fourth level conversion circuit units. The mode switching units respectively correspond to segment driving display units or pixels and are adapted to receive corresponding input mode signal and corresponding clock signal. The clock signals are used as an input signal and supplied to the first level conversion circuit units and the second level conversion circuit unit. Besides, the third level conversion circuit units are electrically coupled to corresponding mode switching units and corresponding segment driving display units. The driving signals are output by the third level conversion circuit units and used to deactivate the display mediums of corresponding segment driving display units so that the modes of the segment driving display units are OFF. The fourth level conversion circuit units are electrically coupled to corresponding mode switching units and corresponding segment driving display units. The driving signals are output by the fourth level conversion circuit units to activate the display mediums of corresponding segment driving display units so that the modes of the segment driving display units are ON. Finally, pursuant to the modes of the input mode signals, the clock signals are supplied to corresponding third level conversion circuit units or corresponding fourth level conversion circuit units.

BRIEF DESCRIPTION OF THE DRAWINGS

The present invention can be fully understood from the following detailed description and preferred embodiment with reference to the accompanying drawings, in which.

DETAILED DESCRIPTION OF THE PREFERRED EMBODIMENTS

The following detailed description is of the best presently contemplated modes of carrying out the invention. This description is not to be taken in a limiting sense, and is made merely for the purpose of illustrating general principles of embodiments of the invention. The scope of the invention is best defined by the appended claims.

Figure 1A:
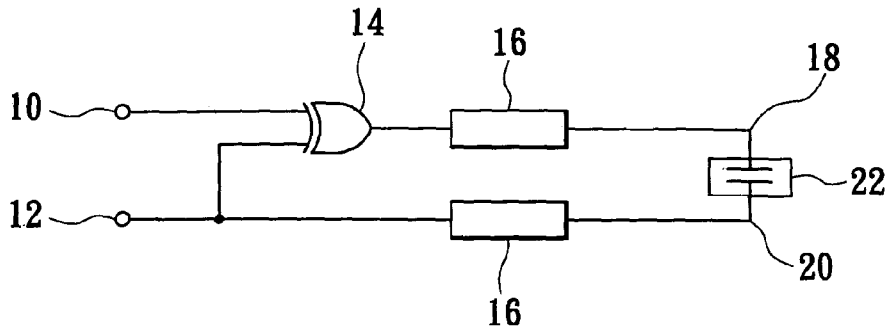
FIG. 1A PRIOR ART
FIG. 1A illustrates a conventional segment driving circuit for a display medium.
Figure 1B:
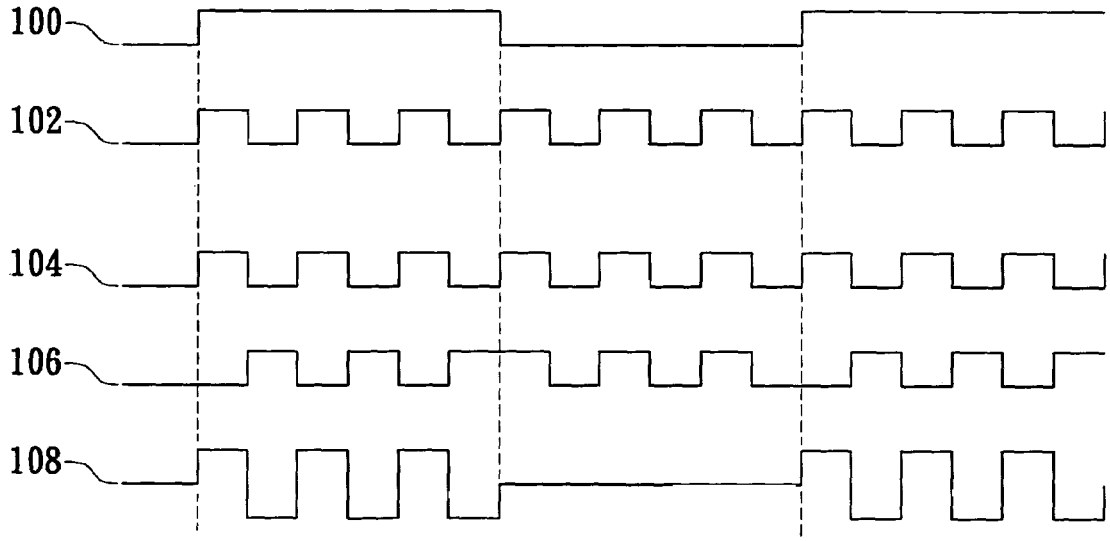
FIG. 1B PRIOR ART
FIG. 1B shows segment driving waveforms of the segment voltages of the conventional segment driving circuit.
Figure 2:
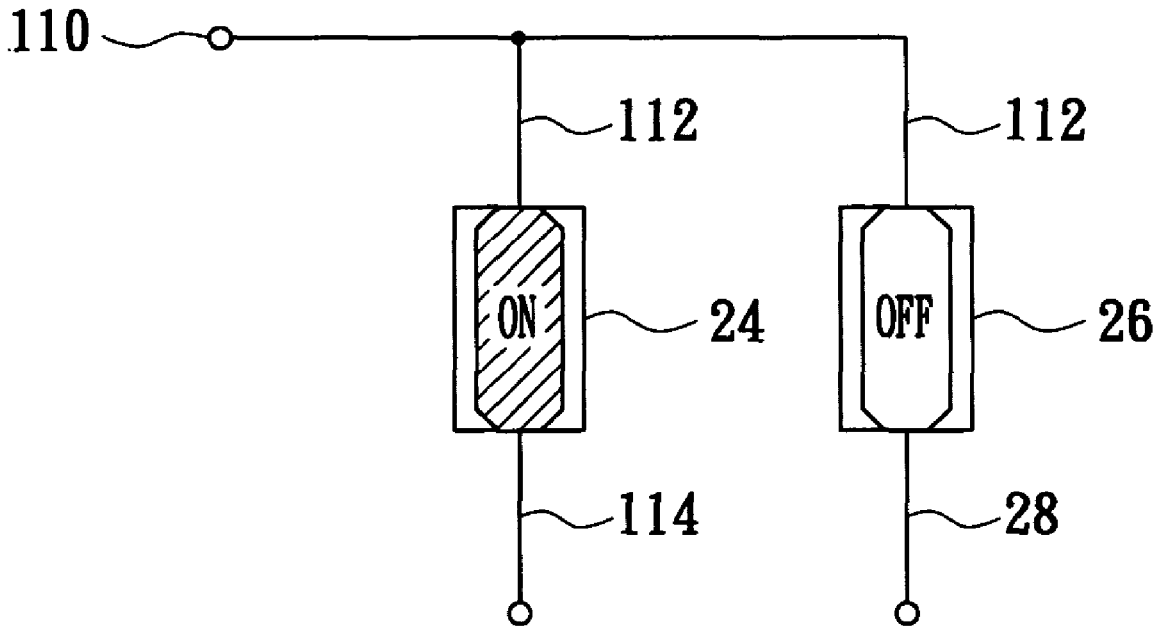
FIG. 2 PRIOR ART
FIG. 2 schematically illustrates a driving circuit for the display device in the prior art.
Figure 3:
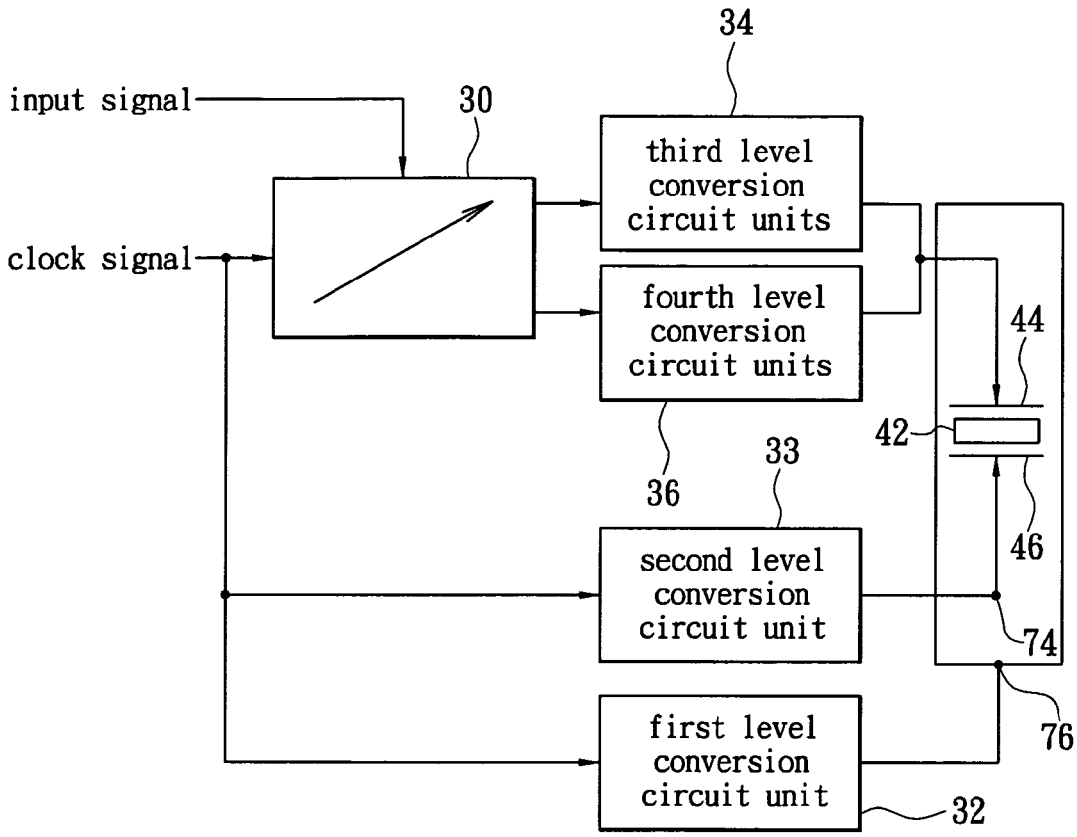
FIG. 3 illustrates a block diagram of a segment driving apparatus in accordance with the present invention.

Reference is made to FIG. 3. FIG. 3 is a block diagram of a segment driving apparatus in accordance with the present invention. The present invention includes a plurality of segment driving display units or pixels 42, a plurality of mode switching units 30, at least one first level conversion circuit unit 32, at least one second level conversion circuit unit 33, a plurality of third level conversion circuit units 34 and a plurality of fourth level conversion circuit units 36. Further referring to FIG. 3, each segment driving display unit 42 includes a first substrate, a second substrate and a display medium layer. The display medium layer can be a liquid crystal layer, an electrophoresis layer or equivalents thereof. The mode switching units 30 respectively correspond to the segment driving display units or pixels 42 and are used to receive corresponding input mode signals and corresponding clock signals. The mode of input mode signals can be "0" or "1". When the mode of input mode signal is 0, the mode switching unit 30 selects the fourth level conversion circuit unit 36 to supply the clock signal to a first terminal 44 of the segment driving display unit 42. The signal supplied to the first terminal 44 has a continuous square wave swinging from the difference between the reference voltages and the OFF mode voltage to the ON mode voltage. In this regard, the segment driving display unit 42 is activated through the first terminal 44.

When the mode of input mode signal is 1, the mode switching unit 30 selects the third level conversion circuit unit 34 to supply the clock signals to a first terminal 44 of the segment driving display unit 42. The signal supplied to the first terminal 44 has a continuous square wave swinging from a sum of the reference voltages and the OFF mode voltage-to the zero. The continuous square wave is used as the segment voltage waveform of the OFF mode. In this regard, the segment driving display unit 42 is activated through the first terminal 44.

Furthermore, the first level conversion circuit units 32 are used to receive the clock signals as first level shift signals. The first level conversion circuit units 32 convert the clock signals into continuous square waves swinging from the OFF mode voltage to the reference voltage. The continuous square waves are regarded as background voltage waveforms of the level shift signals. The second level conversion circuit units 33 are used to receive the clock signals as second level shift signals. The second level conversion circuit units 33 convert the clock signals into continuous square waves swinging from zero to a sum of the OFF mode voltage and the reference voltage. The continuous square waves are regarded as common voltage waveforms of the level shift signals.

The third level conversion circuit units 34 are electrically coupled to corresponding mode switching units 30 and corresponding segment driving display unit 42. Additionally, the third level conversion circuit units 34 convert the clock signals and the input mode signals into the OFF mode output signal.

The fourth level conversion circuit units 36 are electrically coupled to corresponding mode switching units 30 and corresponding segment driving display unit 42. Additionally, the fourth level conversion circuit units 36 convert the clock signals and the input mode signals into the ON mode output signals.

Figure 4:
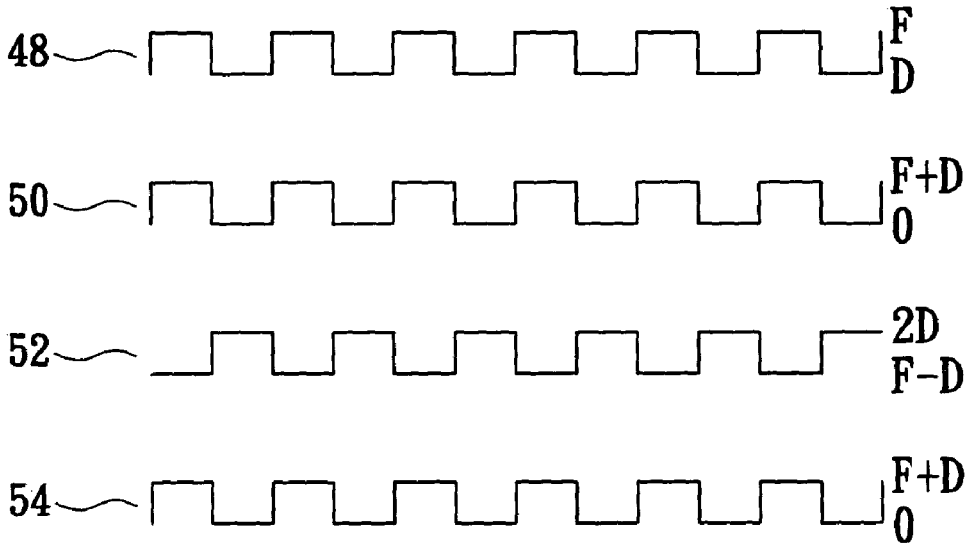
FIG. 4 schematically illustrates a segment driving waveform of the present invention.

Reference is made to FIGS. 3 and 4. FIG. 4 schematically illustrates segment driving waveforms of the present invention. The first level conversion circuit units 32 convert the clock signals into continuous square waves having background voltage waveforms 48. The background voltage waveforms 48 swing from the OFF mode voltage (D) to the reference voltage (F). The second level conversion circuit units 33 convert the clock signals into continuous square waves having common voltage waveforms 50. The common voltage waveforms 50 swing from zero to a sum of the OFF mode voltage and the reference voltage (D+F).

The fourth level conversion circuit units 36 convert the clock signals and the input mode signals into the ON mode output signals having segment voltage waveforms 52. When the mode of input mode signals is "0", the segment voltage waveforms 52 swinging from the difference between the OFF mode voltage and the reference voltage (F−D) to the ON mode voltage (2D) are generated. The segment voltage waveforms 52 are continuous square waves and on the ON mode. When the mode of input mode signals is "1", the segment voltage waveforms 54 swinging from zero to a sum of the OFF mode voltage and the reference voltage (F+D) are generated. The segment voltage waveforms 54 are continuous square waves and on the OFF mode. Then, the third level conversion circuit units 34 convert the clock signal and the input mode signal into the segment voltage waveforms 54 on the OFF mode.

Figure 5:
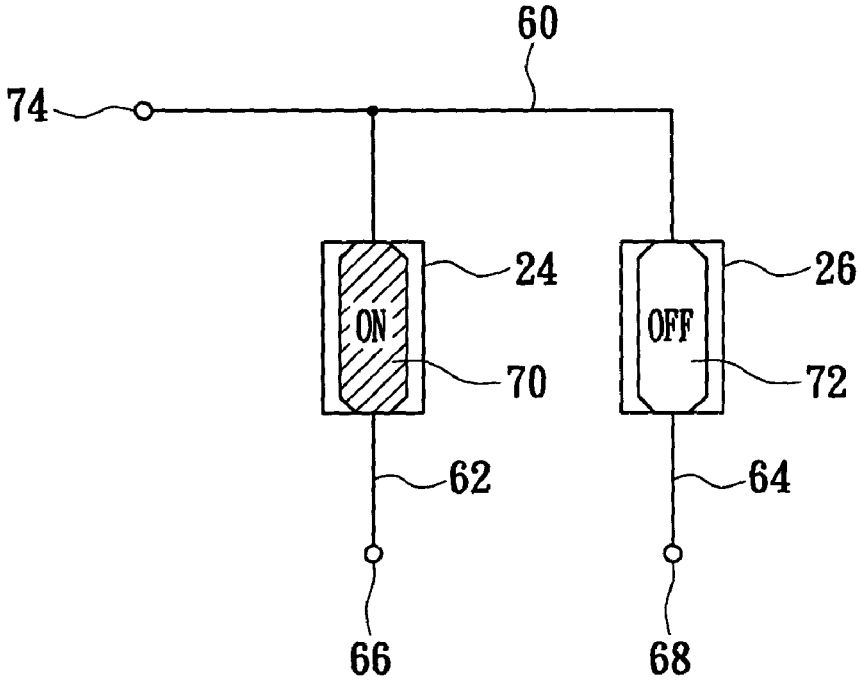
FIG. 5 shows a driving circuit for driving display device in accordance with the present invention.
Figure 5:
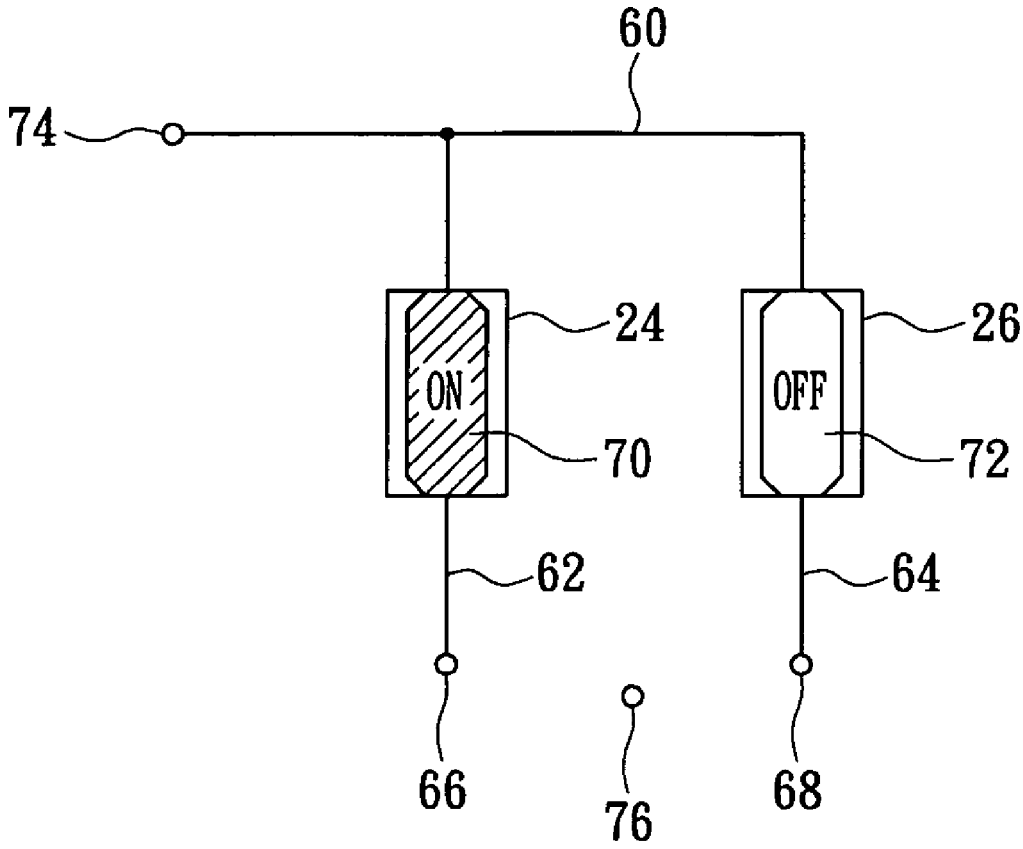

Reference is made to FIG. 5. FIG. 5 shows a driving circuit for driving display device in accordance with the present invention. Referring to FIG. 5, a pixel with the ON mode and a pixel with the OFF mode are shown (FIG. 5 may include more pixels). The ON mode is indicated by a display medium active mode 24, and the OFF mode is indicated by a display medium inactive mode 26. An equation of display medium activation voltage is described below. The equation of the segment driving wire voltage 62 for the ON mode is $V_{LS,ON}=V_{CG}-V_{S1,ON}=(D\rightarrow F)(+)-(F-D\rightarrow 2D)=D(+,-)$. The activation voltage $V_{S1,ON}$ 66 of the segment driving wire is subtracted from a common background voltage $V_{CG}$ so that the segment driving wire voltage 62 for the ON mode $V_{LS,ON}$ is available. That is, the segment driving voltage has a continuous square wave, and the waveform swinging from the difference between the reference voltage and the OFF mode voltage (F−D) to the ON mode voltage (2D) is generated.

According to the present invention, display medium deactivation voltage is available. The equation of the segment driving wire voltage 68 for the OFF mode is $V_{LS,OFF}=V_{CG}-V_{S2,OFF}=(D\rightarrow F)(+)-(F+D)(+)=D(-,+)$. The deactivation voltage $V_{S2,OFF}$ of the segment driving wire is subtracted from a common background voltage $V_{CG}$ so that the segment driving wire voltage $V_{LS,OFF}$ 68 for the OFF mode is available. That is, the segment driving wire voltage has a continuous square wave, and the waveform swinging from a sum (F+D) of the OFF mode voltage and the reference voltage to the difference (F−D) between the OFF mode voltage and the reference voltage is generated. Besides, the following voltages are available. For example, a voltage 60 for common voltage wire is described later. The equation of the voltage 60 is $V_{L,C}=V_C-V_{SG}=(D+F)(+)-(D\rightarrow F)(+)=D(+,-)$. A segment background voltage $V_{SG}$ of the common voltage wire is subtracted from the common voltage 74 so that the voltage 60 for common voltage wire is available. That is, the voltage 60 for common voltage wire has a continuous square wave, and the waveform ranging from a sum (D+F) of the OFF mode voltage and the reference voltage to the difference (F−D) between, the OFF mode voltage and the reference voltage is generated.

Furthermore, the equation of the background voltage $V_G$ is $V_G=V_{CG}-V_{SG}=(D\rightarrow F)(+)-(D\rightarrow F)(+)=0$. The segment driving background voltage $V_{SG}$ is subtracted from the common background voltage $V_{CG}$ so that the background voltage $V_G$ is obtained. Besides, the common background voltage $V_{CG}$ is equal to the segment driving background voltage $V_{SG}$. Thus, numerical value of the background voltage $V_G$ is zero.

The equation of the pixel activation voltage $V_{P,ON}$ 70 is $V_{P,ON}=V_C-V_{S1,ON}=(F-D\rightarrow 2D)(-)=2D(+,-)$. The activation voltage $V_{S1,ON}$ is subtracted from the common voltage $V_C$ so that the pixel activation voltage $V_{P,ON}$ 70 is obtained. That is, the pixel activation voltage $V_{P,ON}$ 70 has a continuous square wave, and the waveform ranging from the difference (F−D) between the OFF mode voltage and the reference voltage to the ON mode voltage (2D) is generated. Additionally, the equation of the pixel deactivation voltage $V_{P,OFF}$ 72 is $V_{P,OFF}=V_C-V_{S2,OFF}=(F+D)(+)-(F+D)(+)=0$. The deactivation voltage $V_{S2,OFF}$ is subtracted from the common voltage $V_C$ so that the pixel deactivation voltage $V_{P,OFF}$ is obtained. That is, the pixel activation voltage $V_{P,FF}$ 72 has a continuous square wave, and a sum (F+D) of the OFF mode voltage and the reference voltage is subtracted from a sum (F+D) of the OFF mode voltage and the reference voltage so that amplitude of the voltage is zero.

Figure 6:
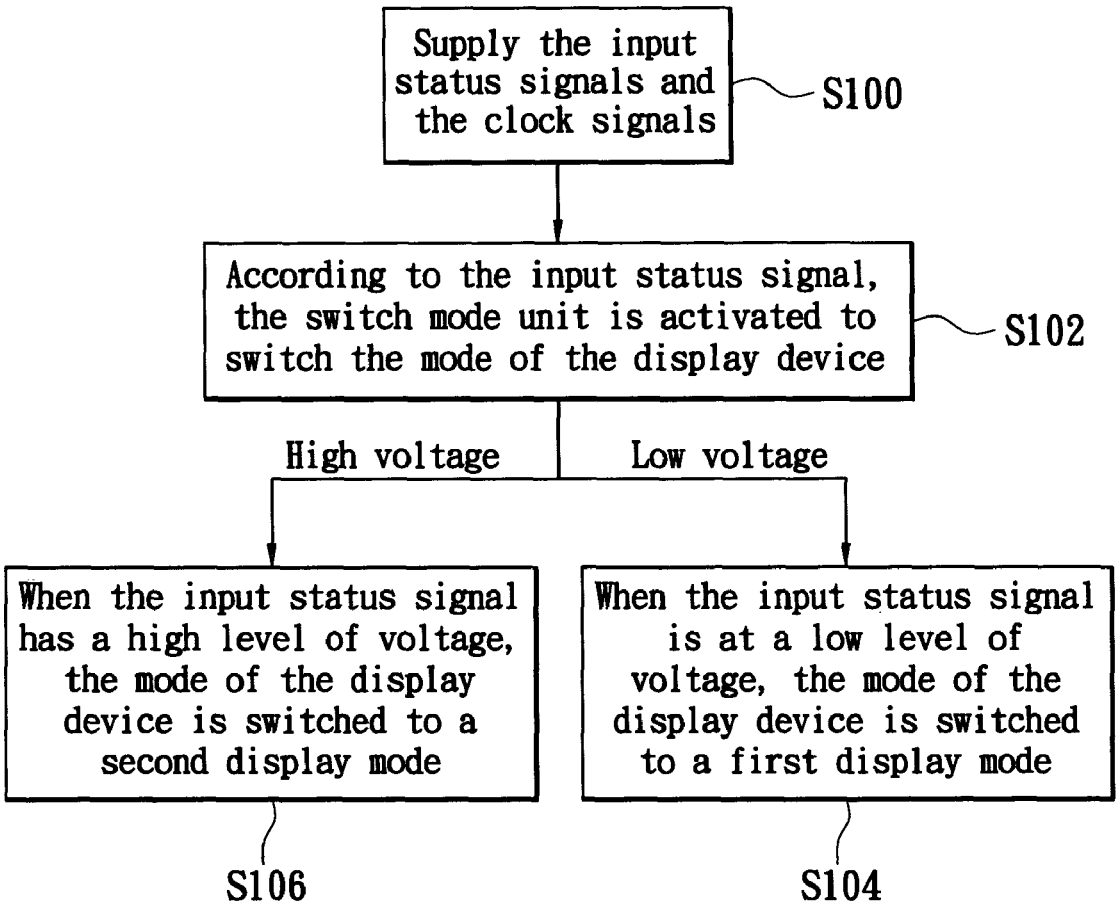
FIG. 6 is a flowchart showing a segment driving method of the present invention.

Reference is made to FIG. 6. FIG. 6 is a flowchart showing a segment driving method of the present invention. The processing of the flowchart is described in detail below.

Step S100: In step S100, an input status signal and a clock signal are supplied. The input mode signal may have a high level of voltage or a low level of voltage. Then, processing goes to step S102.

Step S102: In step S102, according to the input status signal, the switch mode unit is activated to switch the modes of the display device. If the input mode signal is at a low level of voltage, then processing goes to step S104. Otherwise, if the input mode signal has a high level of voltage, then processing goes to step S106.

Step S104: In step S104, the mode of the display device is switched to a first display mode when the input mode signal is at a low level of voltage. The waveform of the first display mode is combination of corresponding segment voltage waveform, corresponding background voltage waveform and corresponding common voltage waveform, and the waveform of the first display mode is the segment voltage waveform of the display activation mode. The background voltage waveform is a continuous square wave and swings from the OFF mode voltage (D) to the reference voltage (F). The equation of the background voltage waveforms is described in detail below.

The common background voltage is $V_{CG}=V_{SG}=(D\rightarrow F)(+)$, where $V_{SG}$ is a segment background voltage and D and F are the OFF mode voltage and the reference voltage, respectively. Requirement is that the OFF mode voltage (D) is lower than a first threshold voltage, which activates the display medium, and the reference voltage F is higher than the OFF mode voltage D.

As shown above, when the first display mode has the segment voltage waveform of the display activation mode, the segment voltage waveform is a continuous square wave and swings from the difference (F−D) between the reference voltage (F) and the OFF mode voltage (D) to the ON mode (2D). The input voltage of the segment voltage waveform of display activation mode is zero. The equation of the input voltage is $V_{S1,ON}=(F-D\rightarrow 2D)(-)$, where $V_{S1,ON}$ is segment electrode voltage of the ON mode and F−D is the difference between the reference voltage (F) and the OFF mode voltage (D). D and F are the OFF mode voltage and the reference voltage, respectively. 2D is the ON mode voltage, and is higher than transmission voltage of nematic liquid crystal display.

Step S106: In step S106, the mode of the display device is switched to a second display mode when the input mode signal has a high level of voltage. The waveform of the second display mode is a combination of corresponding segment voltage waveform, corresponding background voltage waveform and corresponding common voltage waveform. The waveform of the second display mode is the segment voltage waveform of the display deactivation mode. The waveform of the second display mode is 180□ out of phase with that of the first display mode. If the first display mode is ON, then the second display mode is OFF. The common voltage waveform is a continuous square wave and swings from zero to a sum of the OFF mode voltage (D) and the reference voltage (F). The equation of the common voltage is $V_C=(F+D)(+)$, where $V_C$ is the common voltage. D and F are the OFF mode voltage and the reference voltage, respectively. The segment voltage waveform of the display deactivation mode is a continuous square wave and swings from zero to a sum of the OFF mode voltage (D) to the reference voltage (F). The input voltage of the segment voltage waveform of display deactivation mode is "1", and the equation of the segment voltage waveform of display activation mode is described below. The equation of the input voltage is $V_{S2,OFF}=(F+D)(+)$, where $V_{S2,OFF}$ is segment electrode voltage of the OFF mode and F+D is a sum of the reference voltage (F) and the OFF mode voltage (D). D and F are the OFF mode voltage and the reference voltage, respectively.

According to the present invention, the ON mode and the OFF mode of pixels are driven by the driving waveforms, and voltage of any pixel of the display device can be controlled. Thus, those disadvantages of the prior art can be overcome and the following object can be achieved.

1. Driving the electrode wire activation mode is solved by the driving waveforms.

2. The present invention employs signals with one polarity as the input signals and consequently reduces the cost. A symmetrical signal with bi-polarity is therefore generated to impose upon the pixels so that the DC-free continuous driving waveforms are formed. Accordingly, it prevents the display medium from being decomposed and permanently damaged due to continuous DC stress.

3. The driving waveforms of the present invention are applicable to most voltage-driven segment display device no matter what the display medium of the segment display device is.

4. Problems on driving voltage wire activation mode are eliminated, and cost is lowered and processing is simplified.

5. Precise alignment of substrates is not necessary, and production yield can be improved.

While the invention has been described with reference to the preferred embodiments, the description is not intended to be indicated in a limited sense. It is therefore contemplated that the following claims will cover any such modifications or embodiments as may fall within the scope of the invention defined by the following claims and their equivalents.

What is claimed is:

1. A method for driving multi-segment display device, comprising:

supplying an input mode signal and a clock signal;

activating a switch mode unit to switch modes of a display unit according to the input mode signal;

switching the mode of the display device to a display activation mode when the input mode signal is at a low level of voltage; and switching the mode of the display device to a display deactivation mode when the input mode signal is at a high level of voltage, wherein the display activation mode and the display deactivation mode respectively correspond to various combinations of segment voltage waveforms, background voltage waveforms, and common voltage waveforms, and the background voltage waveforms have a same phase as the common voltage waveforms, wherein the segment voltage waveform of the display activation mode is a continuous square wave which swings between a first voltage and a second voltage, and the segment voltage waveform of the display deactivation mode is a continuous square wave which swings between a third voltage and a fourth voltage such that the segment voltage waveforms of the display activation mode and the display deactivation mode have different peak values, and such that the segment voltage waveforms of the display activation mode and the display deactivation mode have different valley values.

2. The method as claimed in claim 1, wherein the background voltage waveform is a continuous square wave and swings from an OFF mode voltage (D) to a reference voltage (F) in accordance with the equation is VCG =VSG=(D→F)(+), where VCG is the background voltage waveform, VSG is a segment background voltage, and D and F are the OFF mode voltage and the reference voltage, respectively.

3. The method as claimed in claim 2, wherein the first voltage is a difference between the reference voltage and the OFF mode voltage and the second voltage is an ON mode voltage (2D), wherein the reference voltage is higher than the OFF mode voltage.

4. The method as claimed in claim 3, wherein the ON mode voltage is higher than a second threshold voltage that is the minimum voltage for sufficiently activating a display medium.

5. The method as claimed in claim 2, wherein the OFF mode voltage is lower than a first threshold voltage that is the minimum voltage for activating a display medium.

6. The method as claimed in claim 2, wherein the reference voltage F is higher than the OFF mode voltage D.

7. The method as claimed in claim 2, wherein the common voltage waveform is a continuous square wave and swings from zero to a sum of the OFF mode voltage (D) and the reference voltage in accordance with the equation of a common voltage VC=(F+D)(+), where VC is the common voltage, and D and F are the OFF mode voltage and the reference voltage, respectively.

8. The method as claimed in claim 2, wherein the third voltage is zero and the fourth voltage is a sum of the reference voltage and the OFF mode voltage.

9. An apparatus for driving a multi-segment display device, comprising:

a plurality of segment driving display units or pixels;

a plurality of mode switching units, corresponding to respective segment driving display units or pixels and adapted to receive corresponding input mode signals and corresponding clock signals;

at least one first level conversion circuit unit, regarding the clock signals as input signals and converting the clock signals into background voltage waveforms;

at least one second level conversion circuit unit, regarding the clock signals as input signals and converting the clock signals into common voltage waveforms having a same phase as the background voltage waveforms;

a plurality of third level conversion circuit units, electrically coupled to corresponding mode switching units and corresponding segment driving display units, each generating a continuous square wave which swings between a valley value with a third voltage and a peak value with a fourth voltage; and a plurality of fourth level conversion circuit units, electrically coupled to corresponding mode switching units and corresponding segment driving display units, each generating a continuous square wave which swings between a valley value with a first voltage and a peak value with a second voltage, wherein the third and first voltages are different and the fourth and second voltages are different.

10. The apparatus as claimed in claim 9, wherein the segment driving display unit includes a first substrate, a second substrate and a display medium layer.

11. The apparatus as claimed in claim 9, wherein modes of input mode signals can be "0" or "1", wherein the first voltage is a difference between a reference voltage and an OFF mode voltage, the second voltage is an ON mode voltage, the third voltage is zero and the fourth voltage is a sum of the reference voltage and the OFF mode voltage, wherein the reference voltage is higher than the OFF mode voltage.

12. The apparatus as claimed in claim 11, wherein the mode switching units select the fourth level conversion circuit unit to supply the clock signals to the segment driving display unit when the mode of input mode signals is 0.

13. The apparatus as claimed in claim 11, wherein the fourth level conversion circuit units generate the continuous square waves as the segment voltage waveforms for display activation mode when the mode of input mode signals is 0.

14. The apparatus as claimed in claim 11, wherein the mode switching units select the third level conversion circuit unit to supply the clock signals to the segment driving display unit when the mode of input mode signals is 1.

15. The apparatus as claimed in claim 11, wherein the third level conversion circuit units generate the continuous square waves as the segment voltage waveforms for display deactivation mode when the mode of input mode signals is 1.

16. The apparatus as claimed in claim 11, wherein the first level conversion circuit units convert the clock signals into continuous square waves of level shift signals as the background voltage waveforms, and the continuous square waves swing from the OFF mode voltage to the reference voltage.

17. The apparatus as claimed in claim 11, wherein the second level conversion circuit units convert the clock signals into continuous square waves of level shift signals as the common voltage waveforms, and the continuous square waves swing from zero to a sum of the OFF mode voltage and the reference voltage.

18. The apparatus as claimed in claim 11, wherein the third level conversion circuit unit and fourth level conversion circuit units convert the clock signals and the input mode signals into corresponding OFF mode output signals or ON mode output signals.

19. A method for driving multi-segment display device, comprising:

supplying an input mode signal and a clock signal;

activating a switch mode unit to switch modes of a display unit according to the input mode signal;

switching the mode of the display device to a display activation mode when the input mode signal is at a low level of voltage; and switching the mode of the display device to a display deactivation mode when the input mode signal is at a high level of voltage, wherein the display activation mode and the display deactivation mode respectively correspond to various combinations of segment voltage waveforms, background voltage waveforms, and common voltage waveforms, and the background voltage waveforms have a same phase as the common voltage waveforms, wherein the segment voltage waveform of the display activation mode is a continuous square wave which swings between a first voltage and a second voltage, and the segment voltage waveform of the display deactivation mode is a continuous square wave which swings between a third voltage and a fourth voltage, and wherein the first voltage is higher than the third voltage, wherein the background voltage waveform is a continuous square wave and swings from an OFF mode voltage (D) to a reference voltage (F) in accordance with the equation is $VCG=VSG=(D\rightarrow F)(+)$, where VCG is the background voltage waveform, VSG is a segment background voltage, and D and F are the OFF mode voltage and the reference voltage, respectively, the first voltage is a difference between the reference voltage and the OFF mode voltage and the second voltage is an ON mode voltage (2D), and the reference voltage is higher than the OFF mode voltage, wherein the ON mode voltage is higher than a second threshold voltage that is the minimum voltage for sufficiently activating a display medium.

* * * * *